US006561115B2

(12) United States Patent
Chase

(10) Patent No.: US 6,561,115 B2
(45) Date of Patent: May 13, 2003

(54) ANCHOR INSERTION DEVICE

(75) Inventor: Brian G. Chase, Act (AU)

(73) Assignee: The United States of America as represented by the Secretary of the Navy, Washington, DC (US)

( * ) Notice: Subject to any disclaimer, the term of this patent is extended or adjusted under 35 U.S.C. 154(b) by 0 days.

(21) Appl. No.: 09/823,006

(22) Filed: Apr. 2, 2001

(65) Prior Publication Data

US 2002/0139287 A1 Oct. 3, 2002

(51) Int. Cl.[7] ..... B63B 21/24

(52) U.S. Cl. ..... 114/294; 114/295; 37/323; 37/345; 239/526

(58) Field of Search ..... 114/295, 294, 114/55; 299/17; 52/155; 37/323, 345; 239/150, 151, 526–527, 528; 175/65–71, 212, 218, 424; 405/244–248

(56) References Cited

U.S. PATENT DOCUMENTS 1,173,355 A * 2/1916 Jones ..... 405/248
1,762,012 A * 6/1930 Every ..... 175/324
1,853,379 A * 4/1932 Rotinoff ..... 405/8
2,555,359 A * 6/1951 Montague ..... 405/238
3,210,897 A * 10/1965 Whittington ..... 52/127.4
3,289,421 A * 12/1966 Hindman ..... 405/228
3,508,513 A * 4/1970 Ilfrey et al. ..... 114/294
3,580,511 A * 5/1971 Hammelman ..... 239/419.5
3,612,406 A * 10/1971 Bass, Jr. ..... 239/526
3,630,036 A * 12/1971 Van Weele ..... 405/233
3,844,449 A * 10/1974 Alter ..... 222/175
3,884,419 A * 5/1975 Geoffray ..... 239/526
3,916,634 A * 11/1975 Woodruff ..... 405/248
4,023,314 A * 5/1977 Tanner ..... 52/23
4,073,079 A * 2/1978 Klinefelter ..... 37/78
4,076,313 A * 2/1978 Sperandeo, III ..... 299/8
4,095,550 A * 6/1978 Kerr ..... 114/295
4,110,989 A * 9/1978 Selkirk ..... 405/248
4,257,722 A * 3/1981 Nakajima ..... 405/248
4,300,857 A * 11/1981 Santamaria ..... 405/70
4,347,802 A * 9/1982 Hossfeld ..... 114/295
4,494,613 A * 1/1985 Tamaki et al. ..... 173/74
4,603,833 A * 8/1986 Christianson ..... 251/94
4,637,758 A * 1/1987 Tamaki et al. ..... 405/248
4,716,849 A * 1/1988 Conn et al. ..... 114/222
5,020,726 A * 6/1991 Myres ..... 239/525
5,361,855 A * 11/1994 Schuermann et al. ..... 175/67
5,566,858 A * 10/1996 Ducker, III ..... 222/3
5,881,506 A * 3/1999 Chapman et al. ..... 52/166
5,887,667 A * 3/1999 Van Zante et al. ..... 175/67
5,901,478 A * 5/1999 Sawyer, Jr. ..... 37/323
RE36,223 E * 6/1999 Schuler ..... 128/205.24
5,919,005 A * 7/1999 Rupiper ..... 405/244
6,000,151 A * 12/1999 Hayes ..... 37/323
6,231,270 B1 * 5/2001 Cacossa ..... 405/248

* cited by examiner

*Primary Examiner*—S. Joseph Morano
*Assistant Examiner*—Ajay Vasudeva
(74) *Attorney, Agent, or Firm*—Harvey A. Gilbert; Donald G. Peck

(57) ABSTRACT

A hand-held tool for a diver has a hollow tube to vent pressurized gas from an interconnected source through an opening in the tube. The vented pressurized gas aerates material of a seabed, and an anchoring system disposed adjacent to the tube is effortlessly inserted in the aerated material by a single diver. The hand-held tool permits an improved method of inserting the anchoring system as compared to the time consuming, strenuous, and noisy hammering procedure that usually requires more than one diver to successfully embed an anchor in the seabed. Different sources of pressurized gas for aerating the material may include a portable gas cylinder, diver's air tank, or hose from a remote source, such as a compressor. Quick-change connectors can be used to quickly and easily connect and disconnect components to supply more gas or add different components that will help insert different anchoring systems.

22 Claims, 4 Drawing Sheets

ANCHOR INSERTION DEVICE

STATEMENT OF GOVERNMENT INTEREST

The invention described herein may be manufactured and used by or for the Government of the United States of America for governmental purposes without the payment of any royalties thereon or therefor.

BACKGROUND OF THE INVENTION

This invention relates to a device to insert an anchoring system in the seabed. More particularly, the device of this invention vents pressurized gas into the material of the seabed to assist insertion of an anchoring system therein.

Anchoring systems, such as anchors or stanchions often need to be securely emplaced in the seabed to secure lines, sensors, etc. Usually, divers have had to hammer the anchoring systems into the sand, sediment, and/or particulate matter making up the material of the seabed.

This emplacement method often creates fatiguing levels of exertion in the divers. For some tasks this method is excessively noisy and can disturb the bottom to such an extent as to impair visibility that could be dangerous for the divers and affect successful completion of the mission. In addition, the weight and bulk of mechanical hammering equipment may prevent effective use of this method where logistic support is limited.

Installers of lawn sprinkling systems have used high pressure water hoses to blast, or wash away soil of the ground to create a hole extending, for example, under sidewalks. Then, a water pipe was pushed through the hole so that water may be supplied to lawn sprinklers on the downstream side of the sidewalk. U.S. Pat. No. 4,149,739 discloses an underwater mining apparatus having a dual passage pipe that uses pumped water for gathering mineral modules and aggregate from the floor of the ocean and transmitting them to a supporting surface vessel.

Thus, in accordance with this inventive concept, a need has been recognized in the state of the art for a portable, diver operated device that aerates material of the seabed to permit quick and nearly effortless insertion of an anchoring system in it.

SUMMARY OF THE INVENTION

The present invention provides a hand-held tool for a diver including a hollow tube to vent pressurized gas from an interconnected source through the tube to aerate material of a seabed and to insert an anchoring system disposed adjacently to the tube in the aerated material. The invention also includes a method of inserting the anchoring system in the aerated material using the hand-held tool.

An object of the invention is to provide a method of and device for inserting an anchoring system in the material of the seabed.

Another object is to provide a device portable by a man to quickly and effortlessly insert an anchoring system in sand, sediment, and/or other organic/inorganic particulate matter of the material of the seabed.

Another object of the invention is to provide a method of and device for insertion of an anchoring system that may be used by a diver while underwater to aerate the material of the seabed with gas to allow insertion of the system therein.

Another object is to provide a device portable by a man that uses pressurized gas to insert an anchor or stanchion in the material of the seabed.

Another object of the invention is to provide a one-man device to insert an anchoring system in the material of the seabed by percolating pressurized gas, such as air, in the seabed adjacent to the anchor.

Another object of the invention is to provide a method of and device for allowing one man to effortlessly insert an anchor deep in the material of the seabed by aerating the material with pressurized air.

Another object of the invention is to provide a device held adjacent to an anchoring system with its tip placed against material of the seabed to aerate the material so that light pressure on the device and anchor inserts them to the required depth therein.

Another object of the invention is to provide a method of and device for inserting an anchoring system in the material of the seabed by a diver that aerates the material with gas from a portable cylinder, diver's air tank, or hose from a remote source, such as a compressor.

Another object is to provide a method of and a one-man tool for inserting anchoring systems underwater using quick-change fittings to expedite coupling of pressurized gas into the material of the seabed.

These and other objects of the invention will become more readily apparent from the ensuing specification when taken in conjunction with the appended claims.

DESCRIPTION OF THE PREFERRED EMBODIMENTS

Figure 1:
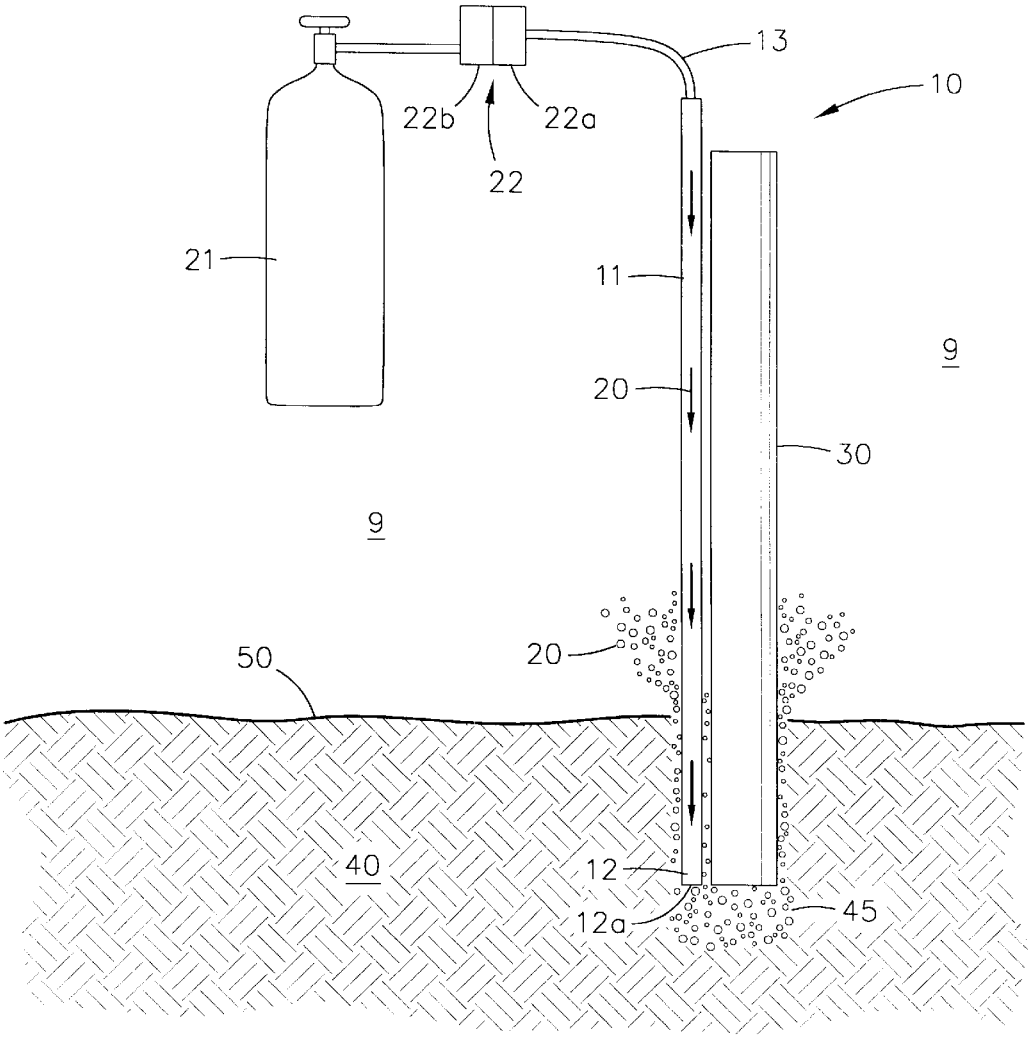
FIG. 1 is a schematic representation of a side view of aqua-jet of this invention shown partially in cross section and adjacent to an anchoring device being inserted into material of the seabed.
Figure 5:
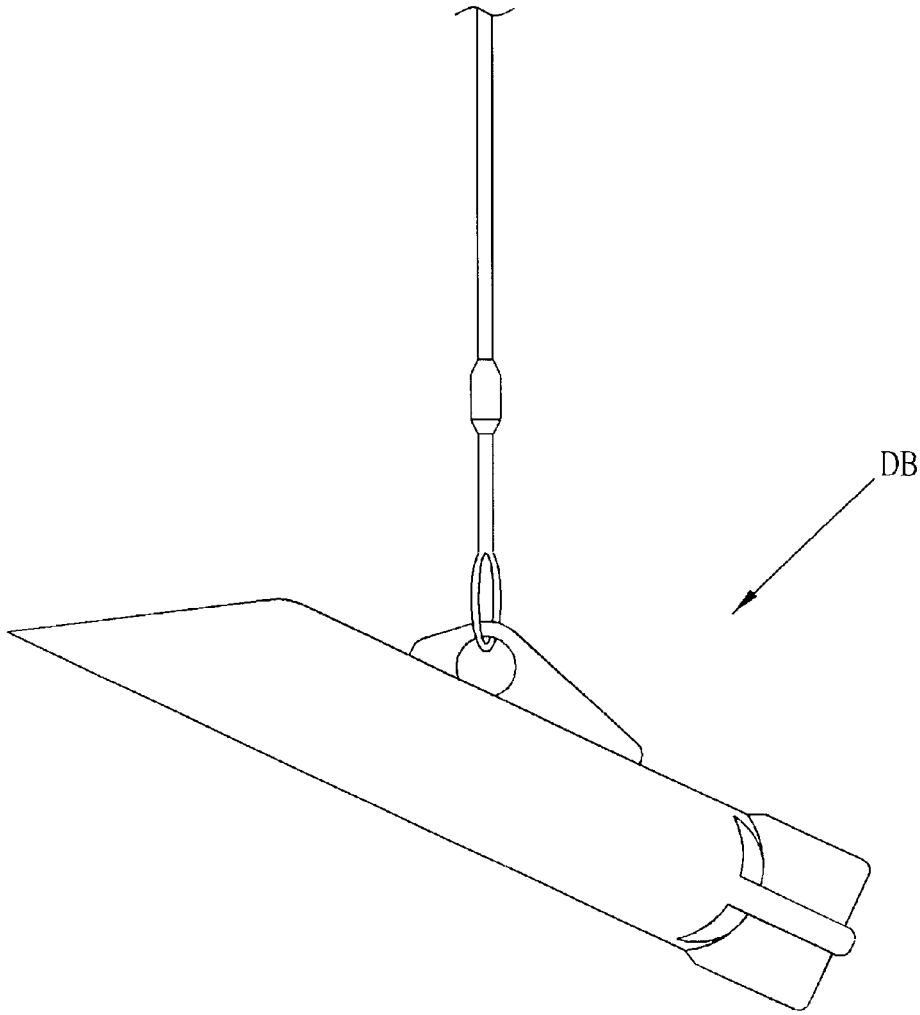
FIG. 5 is a schematic representation of a side view of a typical duckbill anchor that may be inserted as the anchoring system.

Referring to FIG. 1 in accordance with this invention aqua-jet 10 is positioned adjacent to an object including an anchoring system 30, as it is being inserted into material 40 of seabed 50. Material 40 of seabed 50 can be sand, marine sediment, and/or other particulate matter, such as silt for example. Aqua-jet 10 can be built compactly enough to be easily deployed and operated by one-man to assist the insertion of underwater anchoring systems 30, such as stanchions, duckbill anchors, and other anchor designs in material 40. FIG. 5 schematically shows a side view of a typical duckbill anchor DB that may be inserted as anchoring system 30.

Aqua-jet 10 is coupled to deliver a stream 20 of gas from a source of pressurized gas 21 through a hollow tube 11 having a rounded opening 12*a* in tip 12. Gas stream 20 is fed through hollow tube 11 and opening 12*a* which has been placed at, or set on material 40 of seabed 50 and vents, or feeds stream 20 into material 40 beneath and beside anchoring system 30. Hollow tube 11 and tip 12 are made from metal or plastic having sufficient strength to be inserted in material 40 and are large enough to deliver sufficient quantities of pressurized gas stream 20 through them. Hollow tube 11 in one embodiment of aqua-jet 10 was made from three sixteenths inches diameter tubular aluminum. A narrower diameter tubing might be substituted with consequent reduction in the amount of gas used, or a larger diameter tube feeding more gas might be needed for other designs.

These quantities of gas stream 20 can be fed from an interconnected hose 13 through hollow tube 11 and opening 12*a* and into material 40 beneath and beside anchoring system 30. Different gasses including air for stream 20 may be fed from different sources 21. Source 21 therefore, can be a diver's tank of compressed air or other breathing mixtures, a tethered compressor or bank of tanks supplying compressed air or other breathing mixtures, or could be one or more relatively compact $CO_2$ cylinders. $CO_2$ cylinders might be selected as gas source 21 for some tasks since these cylinders can be smaller, are relatively lightweight, and have demonstrated that they can be conveniently connected, used, and replaced to complete a task. Whatever gas and source are selected, however, sufficient quantities must be fed through hose 13 and hollow tube 11 to suitably aerate material 40.

The sand, marine sediment, and/or other silt-like particulate matter of material 40 allows pressurized air stream 20 to aerate it, or percolate through it from tip 12. In accordance with this invention, aeration of material 40 by air stream 20 produces an aerated region 45 of material 40 that allows anchoring system 30 to be effortlessly inserted through it. Since aerated region 45 precedes tip 12 and the adjacent anchoring system 30 as they are being inserted into material 40, anchoring system 30 can be inserted deep into seabed 50 without noticeable exertion by the diver.

Hollow tube 11 of aqua-jet 10 is held adjacent and substantially parallel to anchoring system 30 that is to be inserted in seabed 50. Optionally, hollow tube 11 may be joined to anchoring system 30 with releasible connecting means e.g. ties, clamps, etc., or tube 11 may be an integral part of anchoring system 30, e.g., part of an elongate shank of an anchor. After insertion, the releasible connecting means can be disengaged to free hollow tube 11, or it could be left on the buried anchoring system 30, if desired.

Tip 12 of hollow tube 11 is pushed lightly into material 40, and stream 20 of pressurized gas from source 21 is fed through hollow tube 11 to aerate region 45 of material 40. As aerated region 45 of material 40 becomes aerated, light aligning and guiding pressures are applied to hollow tube 11 and/or anchoring system 30 by the diver, and hollow tube 11 and anchoring system 30 become inserted deeper in material 40. Since hollow tube 11 is being inserted deeper in material 40, stream 20 aerates or percolates through more, or a deeper aerated region 45 of material 40 so that tube 11 and anchoring system 30 can be inserted even more deeply into this deeper aerated region 45 without strenuous aligning and guiding efforts by the diver. This insertion process continues until anchoring system 30 is embedded at the requisite depth in material 40 of seabed 50. This process has been successfully demonstrated underwater at a depth of installation (insertion) from about two to thirty-two feet from the surface of the ocean. The depth of installation could be extended further down by appropriately adjusting (increasing) of the magnitude of pressure of source 21.

Since the aeration of material 40 may vary in accordance with its composition, it is not necessary to continuously apply stream 20 of pressurized gas as anchoring system 30 is inserted. Accordingly, stream 20 need only be fed through hollow tube 11 by the diver when resistance to insertion in material 40 is encountered.

A valve mechanism 22 may be included to control the flow rate and/or volume of stream 20. Valve mechanism 22 is shown in FIG. 1 as located between source 21 and hose 13, or it may be coupled directly between source 21 and hollow tube 11. This direct coupling may be advantageous when, for example, source 21 of pressurized gas 20 is a compact $CO_2$ cylinder coupled to a quick-change connector. In this case, valve mechanism 22 can be a commercially available unit that has switching and manifold components adapted to be coupled to a $CO_2$ cylinder. Optionally, valve mechanism 22 could include a first stage, (or more stages) of a diving tank manifold or conventional diving regulator, or may be any of several different pressure stages and/or valve arrangements from portable or surface supplied sources.

Valve mechanism 22 has an in-line two-position (on, off) valve 22*a* coupled to a first stage 22*b* of a diver's regulator. The regulator is connected to a diving air tank that defines source 21 of pressurized air. The two-way valve 22*a* was found to be somewhat cumbersome, or at least distracting in its operation since the diver had to move a hand from tube 11 and anchoring system 30 to operate valve 22*a*. Consequently, a continuous stream 20 of pressurized air from source 21 usually was delivered, and more air was used than was necessary to achieve satisfactory results. However, this configuration of aqua-jet 10 inserted anchoring system 30 into sand material 40 of seabed 50 in a matter of a few seconds and with little effort by a diver. This period of time compares favorably with the minutes it had taken to insert the same anchoring system 30 by the current exhausting and noisy method of using a slide hammer to hammer it into the seabed.

Figure 2:
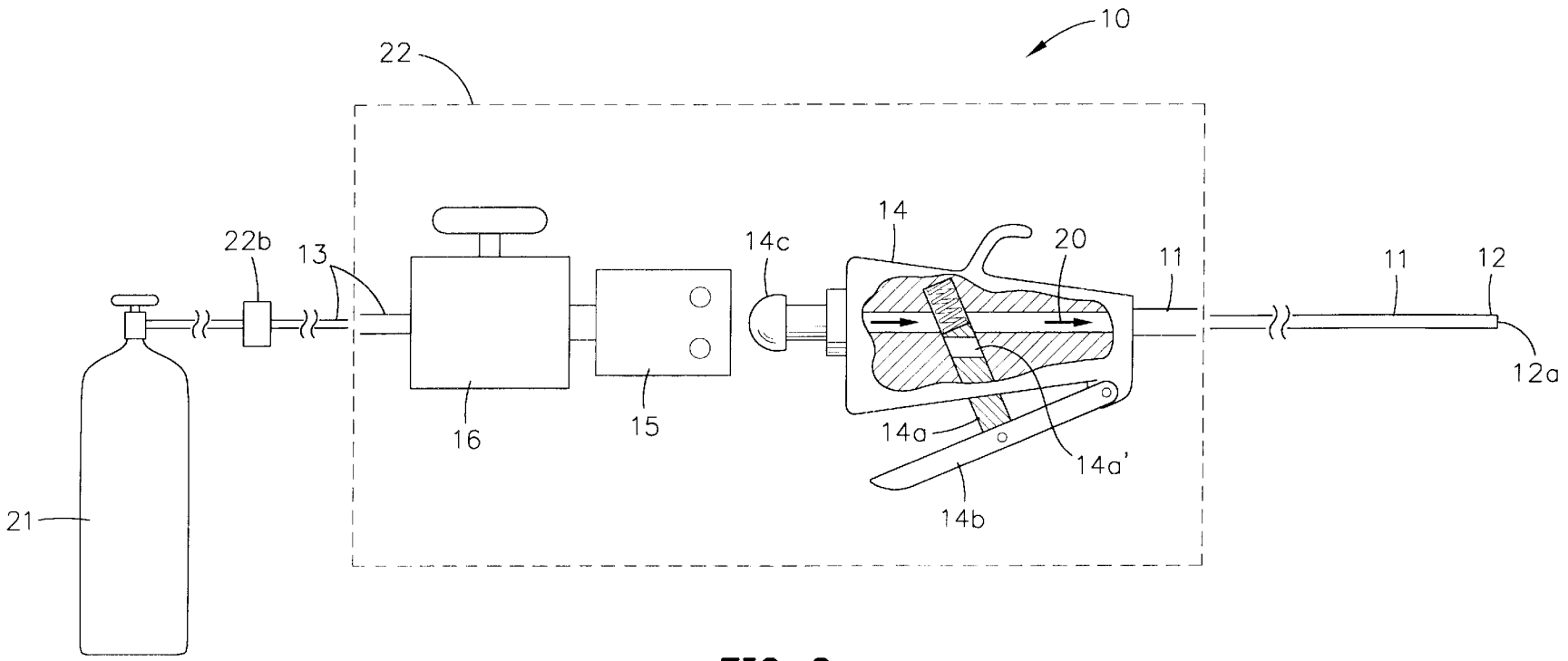
FIG. 2 is a schematic representation of a side view of constituents of another embodiment of aqua-jet according to this invention shown partially in cross section.

Referring to FIG. 2, another embodiment of aqua-jet 10 had hollow tube 11 lengthened to about thirty-nine inches and was attached to a valve mechanism 22 that included trigger assembly 14, quick-change connector 15, and two-way valve 16. Many suitable quick-change connectors as called for herein may be chosen from a wide variety marketed and carried in stock (e.g. ¼" NPT fittings) by many different commercial retailers, such as CAMPBELL HAUSFIELD, LOWES, HOME DEPOT, WALL MART, etc.

The advantages of the convenience of trigger assembly 14 quickly became apparent since it varies flow rates, provides bursts, or gives intermittent (on-off) flows of air stream 20. Trigger assembly 14 has a spring biased internal valve 14*a* having a lateral bore 14*a*' displaced by handle 14*b* that progressively increases the rate of flow of gas through it from a no-flow, or off condition to a full-flow, or on condition as handle 14*b* is progressively squeezed tighter. Additionally, lateral bore 14*a*' of trigger assembly 14 could provide an intermittent flow of gas through it by repetitive, complete rapid displacements of internal valve 14*a* by handle 14*b*. Trigger assembly 14 also has a quick-change portion 14*c* that mates with the rest of quick-change connector 15 that is connected to two-way (on, off) valve 16. Valve 16 may be coupled to a section of hose 13 that extends to first stage 22*b* of a diver's regulator and source 21 of pressurized gas (air). Two-way valve 16 provides a safety feature in case trigger assembly 14 fails. Inclusion of this valve is optional.

Trigger assembly 14 gives the diver control of the length and volume of gas stream 20 required to insert anchoring system 30 in material 40 of seabed 50. Stream 20 may be valved in small bursts or in greater or lesser amounts as needed during the insertion process, and trigger assembly 14 makes more efficient use of gas from source 21.

A diver having only a brief minute of instruction with aqua jet 10 took about fifteen seconds to insert a duckbill anchoring system 30 three feet into material 40 of seabed 50. During insertion, bubbles from air stream 20 came to the surface, but they were much smaller in size than the exhaust bubbles coming from the diver's regulator. The air of the bubbles from air stream 20 apparently was diffused into the smaller bubbles by material 40 of seabed 50.

These embodiments utilized pressurized air having an output pressure from valve mechanism 22 at about 135 psi, the normal pressure from the first stage of a regulator used for diving. Five duckbill type anchors were inserted into a depth of three-and-one-half feet into material 40 of seabed 50. The total amount of air used was one hundred fifty-cubic feet. The average time to insert each duckbill was three to five seconds. The amount of air and time to insert it may vary in accordance with the conditions of the seabed at different sites.

Compared to an anchoring system 30 inserted with aqua-jet 10, an anchoring system hammered in the seabed using conventional hammering gear requires much greater effort, often digging, to remove it as compared to one inserted with aqua-jet 10. This difference in the removal effort is probably due to the effect that the aerating bubbles from air stream 20 cause as they disturb material 40 while they percolate through it. Regardless of this disturbance, anchoring system 30 inserted with aqua-jet 10 holds firm and requires an estimated pressure of greater than one hundred fifty lbs. to extract it. If anchoring system 30 inserted by aqua-jet 10 is left undisturbed in seabed 50 for a time after insertion, diffused air in material 40 escapes, and anchoring system 30 is found to hold as firmly as if the system were inserted by conventional hammering.

Figure 3A:
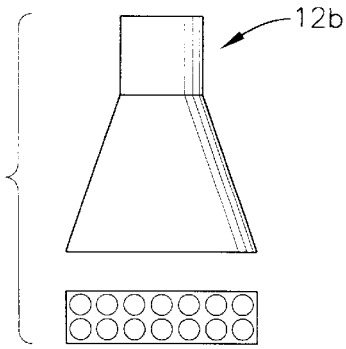
FIGS. 3(*a*) and (*b*) show side and end views of two tips that optionally may be at the tip of the hollow tube of aqua-jet.
Figure 3B:
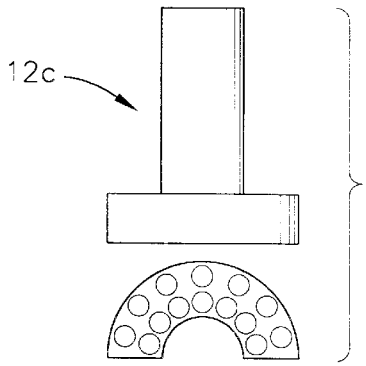

Tip 12 vents air stream 20 through at least one opening 12*a* to aerate material 40 of seabed 50. Opening 12*a* in tip 12 is a rounded aperture, a 90° cut across tube 11, and creates a sufficient pattern of aeration so that aerated region 45 is large enough and well enough defined to allow substantially effortless insertion of anchoring systems 30 shaped as straight bar (stanchion) and duckbill anchors. Opening 12*a* may have other shapes, or more or fewer openings, or apertures of different shapes can be used. Modified tip 12*b* has elongate rows of a plurality of apertures for aerating an elongate region of material 40 for wide anchors, or tip 12*c* has arc-shaped rows of a plurality of apertures for aerating a cylindrical or rounded region of material 40 for larger cylindrical anchors, for examples, see FIGS. 3(*a*) and (*b*). Still other shapes for tip 12 may be fashioned to facilitate insertion of other anchors, and these also may be removably mounted on hollow tube 11 by mating threaded surfaces or inclusion of a quick-change connector 15*a*, see FIG. 4.

Variation of pressure from pressurized gas (air) source 21 permits insertion of differently shaped anchoring systems 30. A pressure gauge having a visual readout (not shown) was appropriately interposed between quick-change connector 15 and two-way valve 16 of aqua-jet 10 to monitor the pressure of air stream 20. Anchoring system 30 included an approximately five foot long duckbill anchor connected to a three-point five-foot or five-foot length of cable to be inserted in material 40 of seabed 50 that consisted of a combination of sand and silt on top of a heavy mud layer (a substance of dense, very fine sediment). Anchoring system 30 areated and penetrated mud relatively easily once it had started.

At one hundred psi pressure aqua-jet 10 performed well and inserted duckbill anchoring system 30 in material 40 of seabed 50 acceptably. At eighty psi pressure aqua-jet 10 still inserted the duckbill system acceptably and performed well, but the insertion rate was slower than at the one hundred psi rate. At sixty psi pressure the duckbill system could not be inserted in material 40, i.e. aqua-jet 10 failed to sufficiently aerate region 45 of material 40. Increasing the pressure of air stream 20 to seventy psi did not improve the insertion capability of aqua-jet 10 and the duckbill system could not be inserted, i.e. aqua-jet 10 failed to aerate material 40. Subsequently increasing the pressure of air stream 20 to eighty psi enabled aqua-jet 10 to insert the duckbill system in aerated region 45 of material 40 acceptably, and aqua-jet 10 performed well, but the insertion rate was slower than at one hundred psi.

This procedure was repeated for a five-foot metal fence post (stanchion) used as anchoring system 30. At eighty psi pressure aqua-jet 10 inserted the five-foot fence post in material 40 acceptably. However, the insertion rate was slow and considerable effort had to be exerted by the diver and his assistant. At ninety psi pressures the insertion capability of aqua-jet 10 was only marginally better with only slightly better performance than at the eighty psi pressure level. At one hundred psi pressure, however, aqua-jet 10 inserted the fence post easily into material 40 with little effort on the part of the diver.

Aqua-jet 10 performs from pressures from eighty psi up. One hundred psi pressure of air stream 20 appears to be an optimal pressure, and increasing the pressure further does not appear to create a noticeable improvement in performance, but only seems to use more air.

Figure 4:
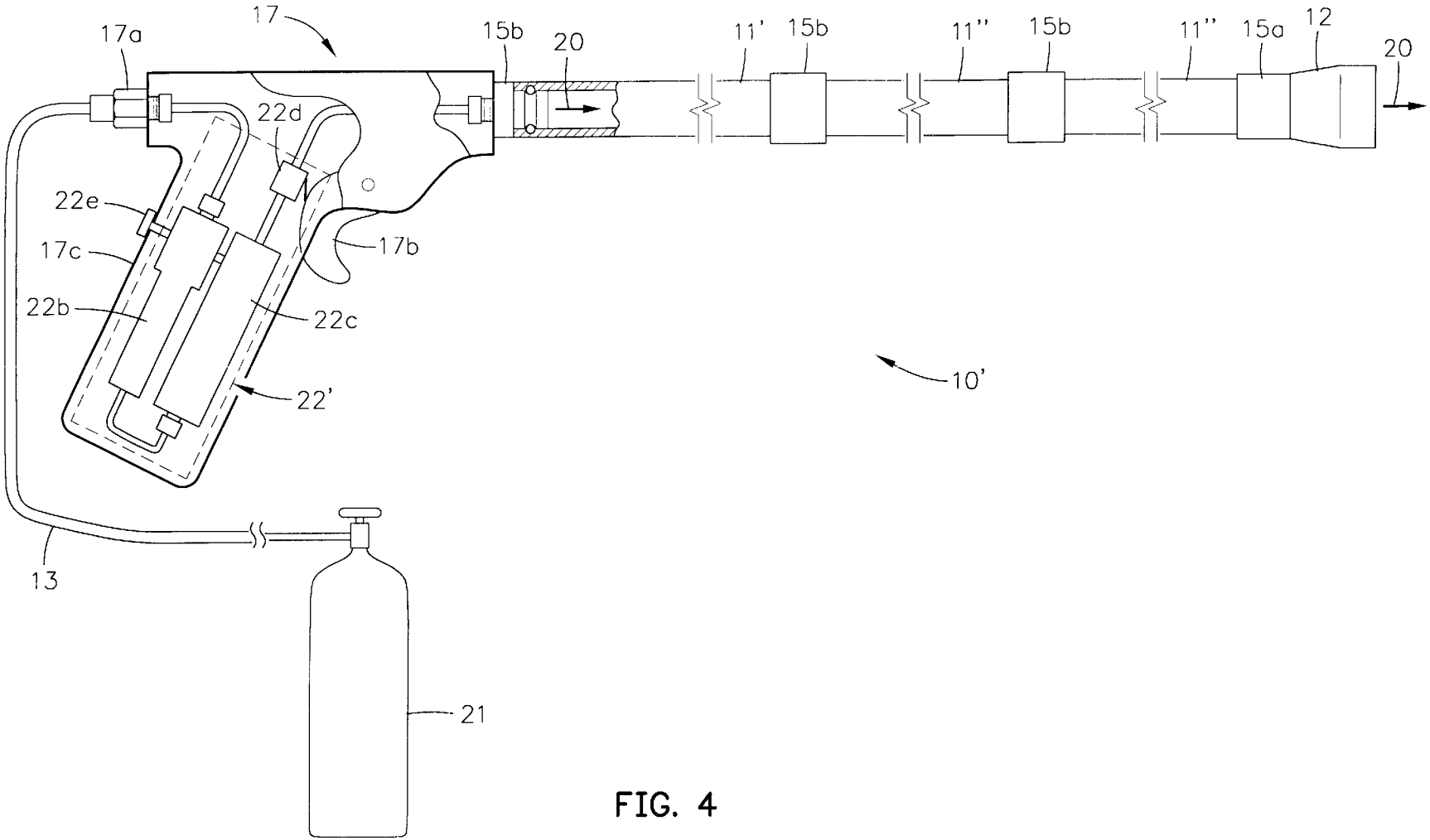
FIG. 4 is a schematic representation of a side view of yet another embodiment of aqua-jet according to this invention shown partially in cross section.

Referring to FIG. 4, aqua jet 10' has hollow tube 11' extending from pistol-shaped structure 17. Structure 17 has a quick-change connector 17*a* to allow a diver-operator to disconnect and reconnect to any practicable source 21 of pressurized gas. These sources may include a high-pressure line extending to a high-pressure compressor, a tank, such as a diver's air tank, or a small cylinder, such as $CO_2$.

Hollow tube 11' is about three feet long and is screwed or otherwise connected in pistol-shaped structure 17 via mating parts of threaded surfaces or a quick-change connector 15*b* well known in the art. Other hollow tubes of different lengths or more lengths of hollow tubes 11" fitted with mating parts of quick-change connectors 15*b* can be added as needed. Insertion of shorter or longer anchoring systems 30 at shallow or deeper levels in material 40 of seabed 50 is quickly done by a diver who selects and connects the tubes needed to get the job done. Tip 12 also is removably mounted by mating parts of quick-change connector 15*a* or mating threaded surfaces on tip 12 and on the outer end of hollow tube 11" so that differently shaped tips can be used to insert different anchoring systems.

Pistol-shaped structure 17 houses valve mechanism 22' receiving high pressure gas from source 21 and feeding stream 20 of pressurized gas to hollow tube 11'. Mechanism 22' receives the pressurized gas at first stage 22*b* (that functions much the same as the first stage of a diving regulator) and reduces the pressure of the gas, and a second stage 22*c* (that functions much the same as the second stage of a diving regulator) receives gas at lower pressure (about 135 psi) from first stage 22*b* and further reduces this pressure to about 100 psi. Air flow switch 22*d* of valve mechanism 22' is coupled to receive the flow of pressurized gas from second stage 22*c* and may vary and/or switch the flow on or off when trigger 17*b* is displaced by a diver. Air flow switch 22*d* can be essentially the same as trigger assembly 14 of FIG. 2 although other suitable designs may be chosen. Connection 22*e* of mechanism 22' extends from at least one of stages 22*b* and 22*c* through handle portion 17*c* of pistol-shaped structure 17 so that a diver can adjust pressure of stream 20 from about eighty to one hundred fifty psi. Connection 22*e* is accessible by the diver to change the flow rate of stream 20 of gas 21 in addition to the capabilities of air flow switch 22*d*. Changed flow rates may be selected by a diver as needed during a task. The varied and/or switched flows of pressurized gas are fed to hollow tube 11' to control the insertion of an anchoring system in the seabed.

Having the teachings of this invention in mind, modifications and alternate embodiments of this invention may be adapted. For examples, aqua-jet 10 might be provided with clamps or other suitable means to engage and hold it next to anchoring system 30 while it is being inserted; the hollow tube 11 of aqua-jet 10 may be made a part of anchoring system 30, and other constituents of aqua-jet 10 are connected to it via a quick-change connector to vent pressurized gas and insert anchoring system 30; after insertion, the quick-change connector can be disconnected leaving hollow tube 11 with the inserted anchoring system 30; aqua-jet 10 can be made in different sizes and fabricated from strong and durable noncorrosive or corrosion resistant materials for reliable operation in the marine environment; aqua-jet 10 can have fibers embedded in the constituent parts for reinforcement.

Aqua-jet 10 can incorporate a number of compact gas manifolds and other valving arrangements such as those that are currently manufactured by companies marketing paint-ball guns. These components use measured amounts of pressurized gas to propel paint balls from paint-ball guns and could be incorporated into aqua-jet 10 as valving and triggering mechanisms to control the flow of pressurized gas. Fixed and rechargeable gas sources for paint-ball guns also could be adapted to aqua-jet 10 to extend the capabilities of a diver. One manufacturer of such components, Palmer's Pursuit Shop, 3951 Development Dr. #three, Sacramento, Calif. 95838 has indicated that their established line of pressure regulator goods (including paint-ball guns) can be adapted to aqua-jet 10.

The disclosed components and their arrangements as disclosed herein all contribute to the novel features of this invention. Aqua-jet 10 is an operator-friendly tool that relatively easily inserts different anchoring systems 30 into material 40 of a body of water's seabed 50. Aqua-jet 10 is designed to be portable and successfully operated to insert anchoring systems 30 by a single diver without imposing burdensome weight and size constraints; however, aqua-jet 10 can be made larger and more substantial for bigger tasks and require more than one diver to operate it successfully. Therefore, aqua-jet 10, as disclosed herein is not to be construed as limiting, but rather, is intended to be demonstrative of this inventive concept.

It should be readily understood that many modifications and variations of the present invention are possible within the purview of the claimed invention. It is to be understood that within the scope of the appended claims the invention may be practiced otherwise than as specifically described.

I claim:

1. A combination diver's tool and anchoring system for insertion in a seabed comprising an anchoring system and a diver's tool having a hollow tube connected to a source of pressurized gas, a valve mechanism coupled to said tube and said source to selectively vary the flow off said pressurized gas, and a quick change fitting coupled to said tube and said source to permit replacement with another source of pressurized gas underwater, said hollow tube being separate from and disposed adjacent to said anchoring system for venting said pressurized gas from an interconnected source through said tube and aerating material of said seabed to permit insertion of said anchoring system disposed adjacent to said tube in said aerated material of said seabed.

2. The combination of claim 1 wherein each source is a tank of compressed gas.

3. The combination of claim 2 wherein said anchoring system is comprised of a straight bar stanchion.

4. The combination of claim 2 wherein said anchoring system is comprised of a duckbill anchor.

5. A method of inserting an object in a seabed comprising the steps of:

positioning a hollow tube having an opening adjacent an object;

coupling a source of pressurized gas to said hollow tube;

placing said opening and said object at a seabed;

venting pressurized gas from said source to and through said hollow tube and said opening;

aerating material of said seabed through said opening with said pressurized gas; and inserting said object and said hollow tube in said aerated material of said seabed, said step of aerating material including the step of deeper aerating said material in said seabed during said step of inserting, said step of inserting including the step of further inserting said object and said hollow tube in said deeper aerated material during said step of deeper aerating, said step of placing including the step of setting said opening of said hollow tube and said object on the surface of said material of said seabed, said step of venting pressurized gas including the step of feeding a stream of pressurized gas through said hollow tube and opening and said object including an anchoring system, and said step of venting including the step of feeding said stream of pressurized gas through said opening formed as a plurality of apertures arranged in at least one curved row in the end of said hollow tube to assure said step of inserting said anchoring system including cylindrical anchoring systems.

6. A method of inserting an object in a seabed comprising the steps of:

positioning a hollow tube having an opening adjacent an object;

coupling a source of pressurized gas to said hollow tube;

placing said opening and said object at a seabed;

venting pressurized gas from said source to and through said hollow tube and said opening;

aerating material of said seabed through said opening with said pressurized gas;

inserting said object and said hollow tube in said aerated material of said seabed, said step of aerating material including the step of deeper aerating said material in said seabed during said step of inserting, said step of inserting including the step of further inserting said object and said hollow tube in said deeper aerated material during said step of deeper aerating, said step of placing including the step of setting said opening of said hollow tube and said object on the surface of said material of said seabed, said step of venting pressurized gas including the step of feeding a stream of pressurized gas through said hollow tube and opening and said object including an anchoring system;

containing a first quick-change connector, two stages of a regulator, trigger-operated switch, and second quick-change connector in a pistol-shaped structure; and coupling said pistol-shaped structure between said source and said hollow tube to feed said stream of pressurized gas therethrough.

7. A method of inserting an object in a seabed comprising the steps of:

positioning a hollow tube having an opening adjacent an object;

coupling a source of pressurized gas to said hollow tube;

placing said opening and said object at a seabed;

venting pressurized gas from said source to and through said hollow tube and said opening;

aerating material of said seabed through said opening with said pressurized gas;

inserting said object and said hollow tube in said aerated material of said seabed, said step of aerating material including the step of deeper aerating said material in said seabed during said step of inserting, said step of inserting including the step of further inserting said object and said hollow tube in said deeper aerated material during said step of deeper aerating, said step of placing including the step of setting said opening of said hollow tube and said object on the surface of said material of said seabed, said step of venting pressurized gas including the step of feeding a stream of pressurized gas through said hollow tube and opening and said object including an anchoring system and said step of venting including the step of feeding said stream of pressurized gas through said opening formed as a plurality of apertures arranged in at least one curved row in the end of said hollow tube to assure said step of inserting said anchoring system including cylindrical anchoring systems;

containing a first quick-change connector, two stages of a regulator, trigger-operated switch, and second quick-change connector in a pistol-shaped structure; and coupling said pistol-shaped structure between said source and said hollow tube to feed said stream of pressurized gas therethrough.

8. A combination anchoring system and device for insertion in material of a seabed comprising:

an anchoring system;

a hollow tube being separate from and disposed adjacent to said anchoring system and extending the length of said anchoring system, said hollow tube having an opening at at least one end thereof;

a source of pressurized gas connected to said hollow tube to feed a stream of pressurized gas therethrough;

means coupled to said-hollow tube and said source for venting said stream of pressurized gas through said hollow tube and said opening to aerate material of a seabed, said aerated material permitting insertion of said anchoring system therein; and a valve mechanism connected between said hollow tube and said source to control the flow of said stream of pressurized gas, wherein said valve mechanism includes a trigger assembly to change the rate of flow of gas from a fully off condition to a fully on condition.

9. The combination of claim 8 wherein said trigger assembly is provided with a spring-biased internal valve displaced by a handle to progressively increase said rate of flow of gas from said fully off condition to said fully on condition.

10. The combination of claim 9 wherein said anchoring system is comprised of a straight bar stanchion.

11. The combination of claim 9 wherein said anchoring system is comprised of a duckbill anchor.

12. The combination of claim 8 wherein said valve mechanism includes a two-way switch.

13. A combination anchoring system and A device for inserting an anchoring system insertion in material of a seabed comprising:

an anchoring system;

a hollow tube being separate from and disposed adjacent to said anchoring system and extending the length of said anchoring system, said hollow tube having an opening at at least one end thereof;

a source of pressurized gas connected to said hollow tube to feed a stream of pressurized gas therethrough;

means coupled to said hollow tube and said source for venting said stream of pressurized gas through said hollow tube and said opening to aerate material of a seabed to permit insertion of said anchoring system in said aerated material; and a valve mechanism connected between said hollow tube and said source to control the flow of said stream of pressurized gas, said valve mechanism including a trigger assembly to change the rate of flow of gas from a fully off condition to a fully on condition, said trigger assembly being provided with a spring-biased internal valve displaced by a handle to progressively increase said rate of flow of gas from said fully off condition to said fully on condition, and said valve mechanism including a pressure regulator having at least one stage coupled to said trigger assembly.

14. The combination of claim 13 wherein said pressure regulator includes an adjustment to change the pressure fed through it.

15. The combination of claim 14 wherein said adjustment of said pressure regulator includes a connection to adjust the pressure of said stream from 80 to 150 psi.

16. The combination of claim 15 wherein said valve mechanism includes a pressure regulator having two stages.

17. A combination anchoring system and device for insertion in material of a seabed comprising:

an anchoring system;

a hollow tube being separate from and disposed adjacent to said anchoring system and having a length to extend the length of said anchoring system, said hollow tube having an opening at at least one end thereof;

a source of pressurized gas connected to said hollow tube to feed a stream of pressurized gas therethrough;

means coupled to said hollow tube and said source for venting said stream of pressurized gas through said hollow tube and said opening to aerate material of a seabed to permit insertion of said anchoring system in said aerated material; and a valve mechanism connected between said hollow tube and said source to control the flow of said stream of pressurized gas, said valve mechanism including a trigger assembly to change the rate of flow of gas, said valve mechanism including a two stage regulator.

18. A combination anchoring system and device for insertion in material of a seabed comprising:

an anchoring system;

a hollow tube being separate from and disposed adjacent to said anchoring system and extending the length of said anchoring system, said hollow tube having an opening at at least one end thereof;

a source of pressurized gas connected to said hollow tube to feed a stream of pressurized gas therethrough; and means coupled to said hollow tube and said source for venting said stream of pressurized gas through said hollow tube and said opening to aerate material of a seabed, said aerated material permitting Insertion of said anchoring system therein;

a valve mechanism connected between said hollow tube and said source to control the flow of said stream of pressurized gas; and at least one quick-change connector connected between said hollow tube and said source.

19. A combination anchoring system and device for insertion in material of a seabed comprising:

an anchoring system;

a hollow tube being separate from and disposed adjacent to said anchoring system and extending the length of said anchoring system, said hollow tube having an opening at at least one end thereof;

a source of pressurized gas connected to said hollow tube to feed a stream of pressurized gas therethrough; and means coupled to said hollow tube and said source for venting said stream of pressurized gas through said hollow tube and said opening to aerate material of a seabed, said aerated material permitting insertion of said anchoring system therein;

a valve mechanism connected between said hollow tube and said source to control the flow of said stream of pressurized gas;

a plurality of separate hollow tubes; and a quick-change connector connected between adjacent ones of said plurality of hollow tubes to form an elongate hollow tube having said opening.

20. A combination anchoring system and device for insertion in material of a seabed comprising:

an anchoring system;

a plurality of separate hollow tubes being separate from and disposed adjacent to said anchoring system;

a quick-change connector connected between adjacent ones of said plurality of hollow tubes to form an elongate hollow tube having said opening, said hollow tube having a length to extend adjacent to said anchoring system and said opening at at least one end thereof;

a source of pressurized gas connected to said hollow tube to feed a stream of pressurized gas therethrough;

means coupled to said hollow tube and said source for venting said stream of pressurized gas through said hollow tube and said opening to aerate material of a seabed to permit insertion of said anchoring system in said aerated material; and a valve mechanism connected between said hollow tube and said source to control the flow of said stream of pressurized gas, said valve mechanism including a trigger assembly to change the rate of flow of gas from a fully off condition to a fully on condition, said trigger assembly being provided with a spring-biased internal valve displaced by a handle to progressively increase said rate of flow of gas from said fully off condition to said fully on condition, said valve mechanism including a pressure regulator having two stages coupled to said trigger assembly, said pressure regulator including an adjustment to change the pressure fed through it, said adjustment of said pressure regulator including from 80 to 150 a connection to adjust the pressure of said stream psi.

21. A combination anchoring system and device for insertion in material of a seabed comprising:

an anchoring system;

a hollow tube being separate from and disposed adjacent to said anchoring system and extending the length of said anchoring system, said hollow tube having an opening at at least one end thereof;

a source of pressurized gas connected to said hollow tube to feed a stream of pressurized gas therethrough;

means coupled to said hollow tube and said source for venting said stream of pressurized gas through said hollow tube and said opening to aerate material of a seabed, said aerated material permitting insertion of said anchoring system therein;

a valve mechanism connected between said hollow tube and said source to control the flow of said stream of pressurized gas; and a tip at said opening having at least one elongate row of apertures to provide an elongate aerated region of said material of said seabed.

22. A combination anchoring system and device for insertion in material of a seabed comprising:

an anchoring system;

a hollow tube being separate from and disposed adjacent to said anchoring system and extending the length of said anchoring system, said hollow tube having an opening at at least one end thereof;

a source of pressurized gas connected to said hollow tube to feed a stream of pressurized gas therethrough;

means coupled to said hollow rube aid seal source for venting said stream of pressurized gas through said hollow tube and said opening to aerate material of a seabed, said aerated material permitting insertion of said anchoring system therein;

a valve mechanism connected between said hollow tube and said source to control the flow of said stream of pressurized gas; and a tip at said opening having at least one curved row of apertures to provide a curved aerated region of said material of said seabed.

* * * * *